US006935413B2

(12) United States Patent
Kamishima et al.

(10) Patent No.: US 6,935,413 B2
(45) Date of Patent: Aug. 30, 2005

(54) HEAT EXCHANGER

(75) Inventors: Hiromitsu Kamishima, Isesaki (JP); Hirotaka Kado, Isesaki (JP); Kenichi Wada, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/436,105

(22) Filed: May 13, 2003

(65) Prior Publication Data

US 2003/0213583 A1 Nov. 20, 2003

(30) Foreign Application Priority Data

May 15, 2002 (JP) ..... 2002-139807

(51) Int. Cl.[7] ..... F25B 39/04

(52) U.S. Cl. ..... 165/119; 165/132; 165/110; 62/509

(58) Field of Search ..... 165/132, 82, 110; 62/509

(56) References Cited

U.S. PATENT DOCUMENTS

| | | | | | |
|---|---|---|---|---|---|
| 3,064,819 | A | * | 11/1962 | Jones | 210/266 |
| 4,079,855 | A | * | 3/1978 | Avrea | 220/203.26 |
| 5,082,051 | A | | 1/1992 | Ando | |
| 5,127,466 | A | | 7/1992 | Ando | |
| 5,325,914 | A | | 7/1994 | Tanaka | |
| 5,348,079 | A | | 9/1994 | Tanaka | |
| 5,666,791 | A | * | 9/1997 | Burk | 62/474 |
| 5,785,119 | A | | 7/1998 | Watanabe et al. | |
| 5,868,196 | A | | 2/1999 | Tanaka | |
| 5,975,197 | A | | 11/1999 | Kado | |
| 6,035,931 | A | | 3/2000 | Kado et al. | |
| 6,260,379 | B1 | * | 7/2001 | Manwill et al. | 62/509 |
| 6,289,979 | B1 | | 9/2001 | Kato | |
| 6,360,560 | B1 | * | 3/2002 | Whitlow et al. | 62/509 |
| 6,622,517 | B1 | * | 9/2003 | Whitlow et al. | 62/474 |
| 2002/0125003 | A1 | | 9/2002 | Iino et al. | |

FOREIGN PATENT DOCUMENTS

| | | |
|---|---|---|
| DE | 1601045 | 6/1979 |
| EP | 0669506 | 8/1995 |
| EP | 0921022 A2 | 6/1999 |
| JP | 07180930 | 7/1995 |
| JP | 7301472 | 11/1995 |
| JP | 9280780 | 10/1997 |
| JP | 10290091 | 10/1998 |
| JP | 2000074528 | 3/2000 |
| JP | 2001041612 | 2/2001 |
| JP | 2001263869 | 9/2001 |
| WO | 9910690 | 3/1999 |

* cited by examiner

*Primary Examiner*—Allen J. Flanigan
(74) *Attorney, Agent, or Firm*—Baker Botts L.L.P.

(57) ABSTRACT

A heat exchanger includes a pipe having an opening formed therein, and an insert positioned within the pipe. The heat exchanger also includes a cap member for sealing the opening, and a support member for resiliently supporting the insert. Specifically, the support member is positioned between the insert and the cap member.

15 Claims, 6 Drawing Sheets

HEAT EXCHANGER

BACKGROUND OF THE INVENTION

1. Field of the Invention

The present invention relates generally to a heat exchanger. In particular, the present invention is directed toward a heat exchanger in which an insert positioned within a pipe of the heat exchanger is resiliently supported by an elastic support member.

2. Description of Related Art

A known heat exchanger, such as the heat exchanger described in Japanese Unexamined Patent Publication No. H09-53867, includes a pair of header pipes. The header pipes communicate with each other via a plurality of tubes, and a plurality of fins are positioned between the tubes. A receiver is positioned adjacent to one of the header pipes. The receiver holds a desiccant unit, and the desiccant unit includes a desiccant. Specifically, the desiccant unit is suspended within the receiver via a cap threaded through an end of the receiver. A partitioning plate is positioned inside the receiver to form a tank area within the receiver.

In such known heat exchangers, the desiccant unit is suspended within the receiver by aligning the desiccant unit with the cap, and turning the cap in a predetermined direction to secure the desiccant unit to the receiver. To remove the desiccant unit from the receiver, e.g., in order to perform maintenance work on the desiccant unit, the cap is turned in a direction opposite the predetermined direction, and the desiccant unit is removed from the receiver.

During operation of such known heat exchangers, however, the heat exchanger vibrates. The vibration of the heat exchanger vibrates the desiccant unit, such that the desiccant unit may generate a predetermined amount of noise or may become damaged, or both.

SUMMARY OF THE INVENTION

Therefore, a need has arisen for a heat exchanger which overcomes these and other shortcomings of the related art. A technical advantage of the present invention is that when the heat exchanger vibrates, an amount of noise generated by the desiccant unit is less than the amount of noise generated by the vibration of the known heat exchangers. Another technical advantage of the present invention is that when the heat exchanger vibrates, the desiccant unit is less likely to be damaged.

According to an embodiment of the present invention, a heat exchanger comprises a pipe having at least one opening formed therein, and an insert positioned within the pipe. The heat exchanger also comprises at least one cap member for sealing the at least one opening, and a support member for resiliently supporting the insert. Specifically, the support member is positioned between the insert and the at least one cap member.

Other objects, features, and advantage will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

DETAILED DESCRIPTION OF PREFERRED EMBODIMENTS

Preferred embodiments of the present invention and their features and advantages may be understood by referring to FIGS. 1–6, like numerals being used for like corresponding parts in the various drawings.

Figure 1:
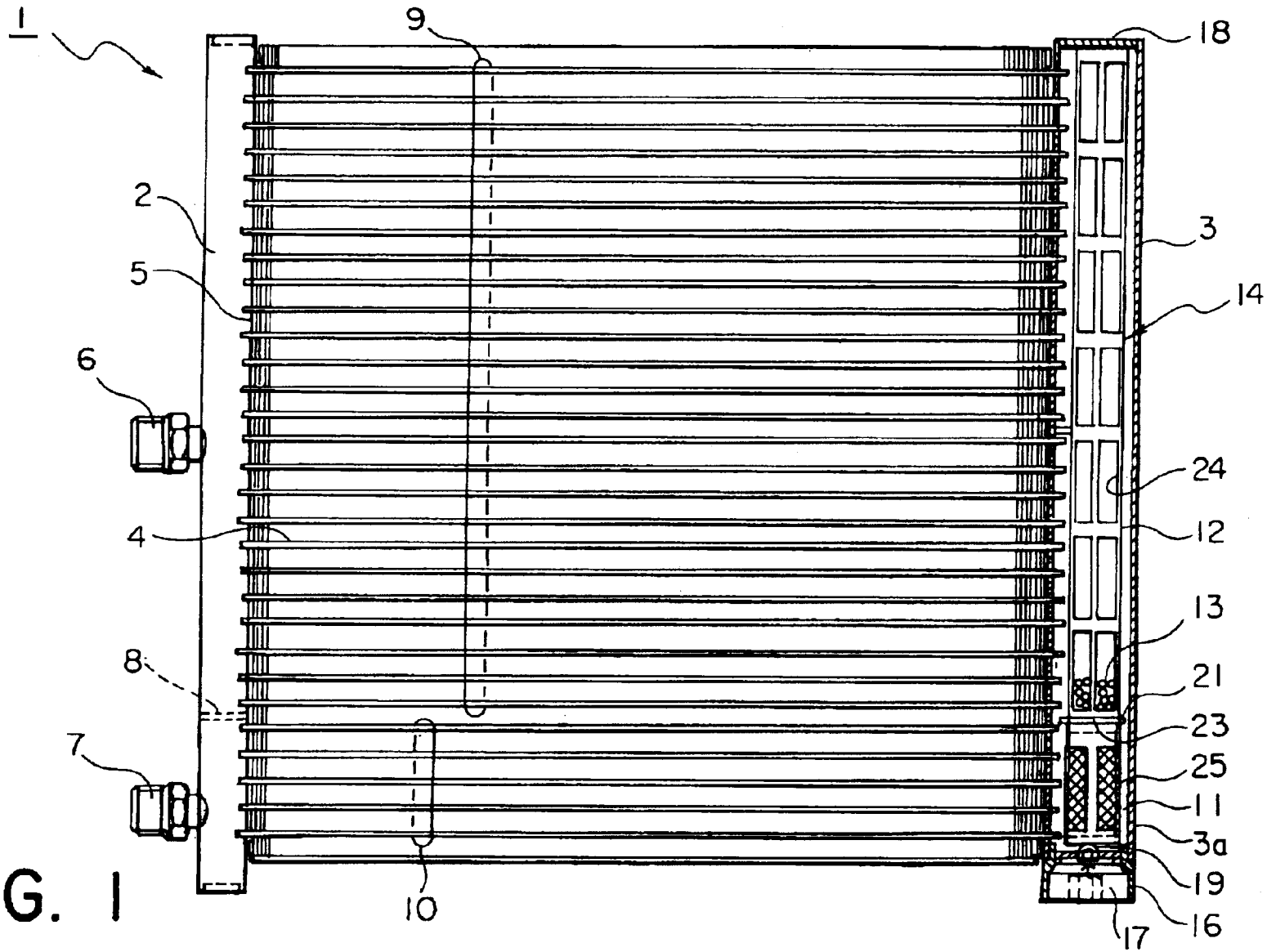
FIG. 1 is a partial, cutaway view of a heat exchanger according to an embodiment of the present invention.

Referring to FIG. 1, a heat exchanger 1, e.g., a subcool-type condenser, for use in an air conditioning system (not shown) of a vehicle (not shown) according to an embodiment of the present invention is depicted. Heat exchanger 1 may comprise a first header pipe 2 and a second header pipe 3, which may be positioned parallel to each other. Heat exchanger 1 also may comprise a plurality of heat exchange tubes 4 allowing communication between first header pipe 2 and second header pipe 3. Each heat exchange tube 4 may be positioned perpendicular to first header pipe 2 and second header pipe 3. Heat exchanger 1 further may comprise a plurality of fins 5 positioned between adjacent heat exchange tubes 4. First header pipe 2 may comprise a refrigerant inlet pipe 6 connected to an upper portion of first header pipe 2, and a refrigerant outlet pipe 7 connected to a lower portion of header pipe 2 First header pipe 2 also may comprise a partitioning plate 8 positioned within first header pipe 2. Partitioning plate 8 divides an interior of first header pipe 2 into an upper volume and a lower volume. The partitioning plate 8 also divides heat exchange tubes 4 into a first plurality of heat exchange tubes which form a refrigerant condensing core 9 for condensing a refrigerant introduced into heat exchanger 1, and a second plurality of heat exchange tubes which form a subcool core 10 for cooling the condensed refrigerant. Specifically, the refrigerant may be introduced into first header pipe 2 via inlet pipe 6. The refrigerant then may pass through each of the first plurality of heat exchange tubes, e.g., in a known single-pass mode or a known double-pass mode, and into second header pipe 3. The refrigerant then may flow into subcool core 10. Specifically, the refrigerant passes through each of the second plurality of heat exchange tubes and exits heat exchanger 1 via outlet pipe 7.

In an embodiment of the present invention, the volume of subcool core 10 may be between about 5% and about 12% of the total volume of heat exchanger 1. Specifically, the volume of subcool core 10 may be selected, such that a cooling rate of heat exchanger 1 is optimized, and a pressure at a high-pressure side heat exchanger 1 is less than a predetermined pressure. Moreover, second header pipe 3 may comprise a header portion 3*a* connected to an inlet side of subcool core 10. Header portion 3*a* may form a liquid tank 11 for storing a liquid refrigerant. Specifically, the refrigerant from refrigerant condensing core 9 may be stored in tank 11, and then may flow into each of the second plurality of heat exchange tubes 4 of subcool core 10. An insert 14, e.g., a desiccant unit, may be positioned within second header pipe 3. Insert 14 may comprise a case 12 and a desiccant 13 positioned inside case 12. Insert 14 may comprise a plurality of holes 24 formed therethrough, and a strainer portion 25.

Figure 2:
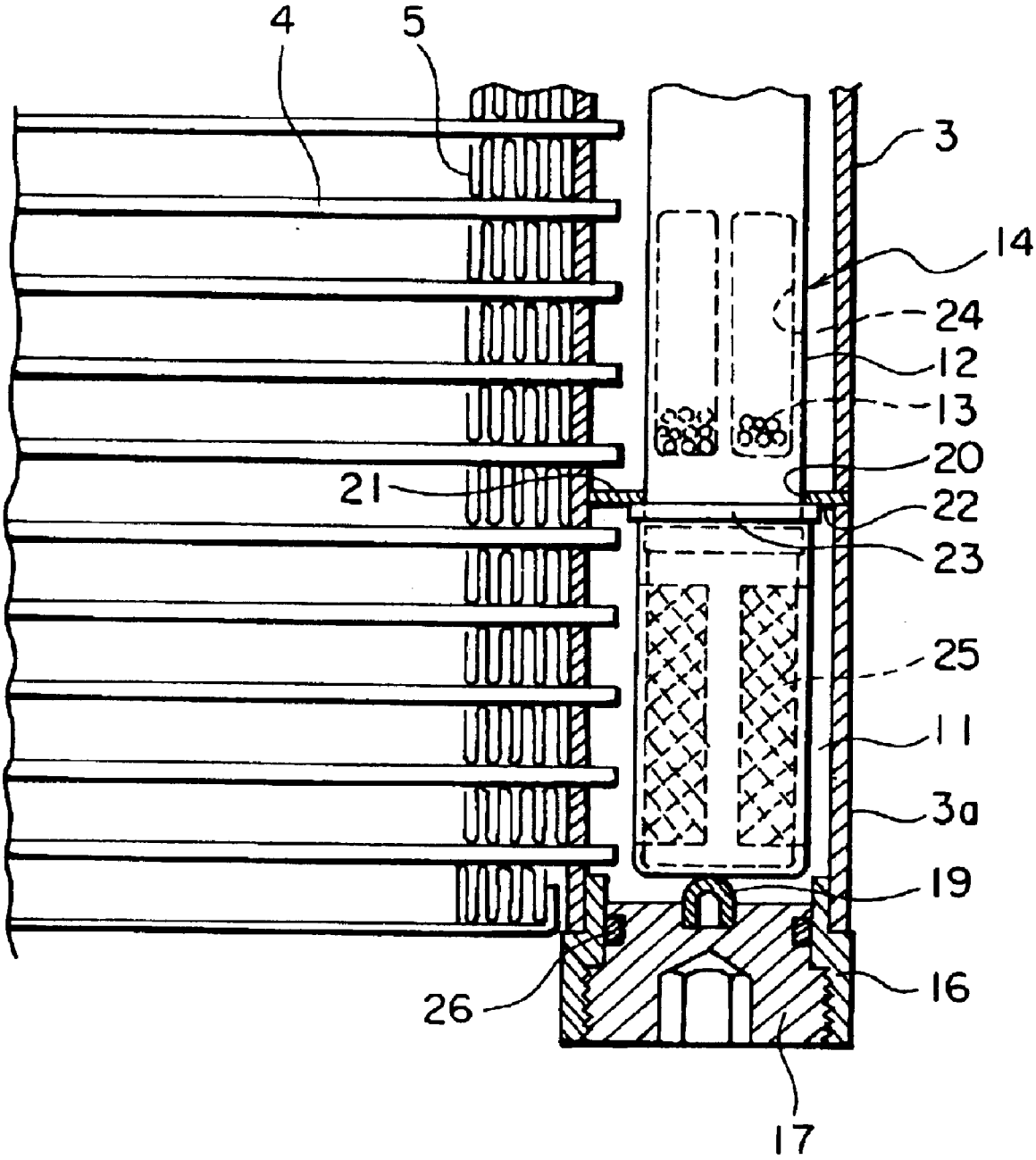
FIG. 2 is an enlarged, partial, cutaway view of a header pipe of a heat exchanger according to an embodiment of the present invention.

Referring to FIG. 2, second header pipe 3 may comprise a first opening formed through a first end, e.g., a lower end, of second header pipe 3, and a second opening formed through a second end, e.g., an upper end, of header pipe 3. A cylindrical member 16 may be fixed to second header pipe 3, e.g., via brazing, such that at least a portion of cylindrical member 16 may be positioned within the first opening of second header pipe 3. Cylindrical member 16 may comprise an opening, e.g., a threaded opening formed therein. A first cap 17 may be screwed into the opening of cylindrical member 16, such that cylindrical member 16 and first cap 17 seal the first opening of second header pipe 3. Moreover, a seal member 26 may be positioned between first cap 17 and an inner surface of cylindrical member 16, and a second cap 18 may seal the second opening of second header pipe 3.

In an embodiment of the present invention, an elastic protrusion 19, e.g., a protrusion manufactured from rubber, resin, or the like, may be fixed to first cap 17. For example, elastic protrusion 19 may be press fitted into an opening formed in first cap 17, such that a first portion of elastic protrusion 19 is positioned within the opening of first cap 17, and a second portion of elastic protrusion 19 is positioned outside the opening of first cap 17. The second portion of elastic protrusion 19 may engage insert 14, such that elastic protrusion 19 resiliently supports insert 14. In another embodiment of the present invention, the second portion of elastic protrusion 19 may be fixed to insert 14, such that the first portion of elastic protrusion 19 may move into and out of the opening of first cap 17.

Second header pipe 3 also may comprise an annular supporting plate 21 positioned within second header pipe 3. Annular supporting plate 21 may comprise an insert hole 20 formed therethrough. Moreover, a first portion of insert 14 may be positioned above annular supporting plate 21, a second portion of insert 14 may be positioned within insert hole 20, and a third portion of insert 14 may be positioned below annular supporting plate 21. Specifically, insert 14 also may comprise an annular flange 23 having an outer diameter which is greater than a diameter of insert hole 21, such that when annular flange 23 engages a lower surface 22 of annular supporting plate 21, annular flange 23 seals a gap formed between the second portion of insert 14 and a surface of insert hole 20. For example, annular flange 23 may be integrally formed with insert 14, or may be an annular member bonded to the outer surface of insert 14. Annular flange 23 also may be positioned below annular supporting plate 21, such that insert 14 is resiliently supported between annular supporting plate 21 and elastic protrusion 19. When insert 14 vibrates, e.g., when heat exchanger 1 vibrates, elastic protrusion 19 may compress and deform to absorb the vibrational motion of insert 14. Consequently, noise generated by the vibration of insert 14 may be reduced relative to the noise generated by the vibration of inserts in known heat exchangers, and insert 14 may not be damaged by such vibration. Moreover, when annular flange 23 engages annular supporting plate 21, annular flange 23 may prevent refrigerant from passing through insert hole 20 without first passing through strainer portion 25. Consequently, the heat exchange efficiency of heat exchanger 1 may be greater than the heat exchange efficiency of known heat exchangers.

Figure 3:
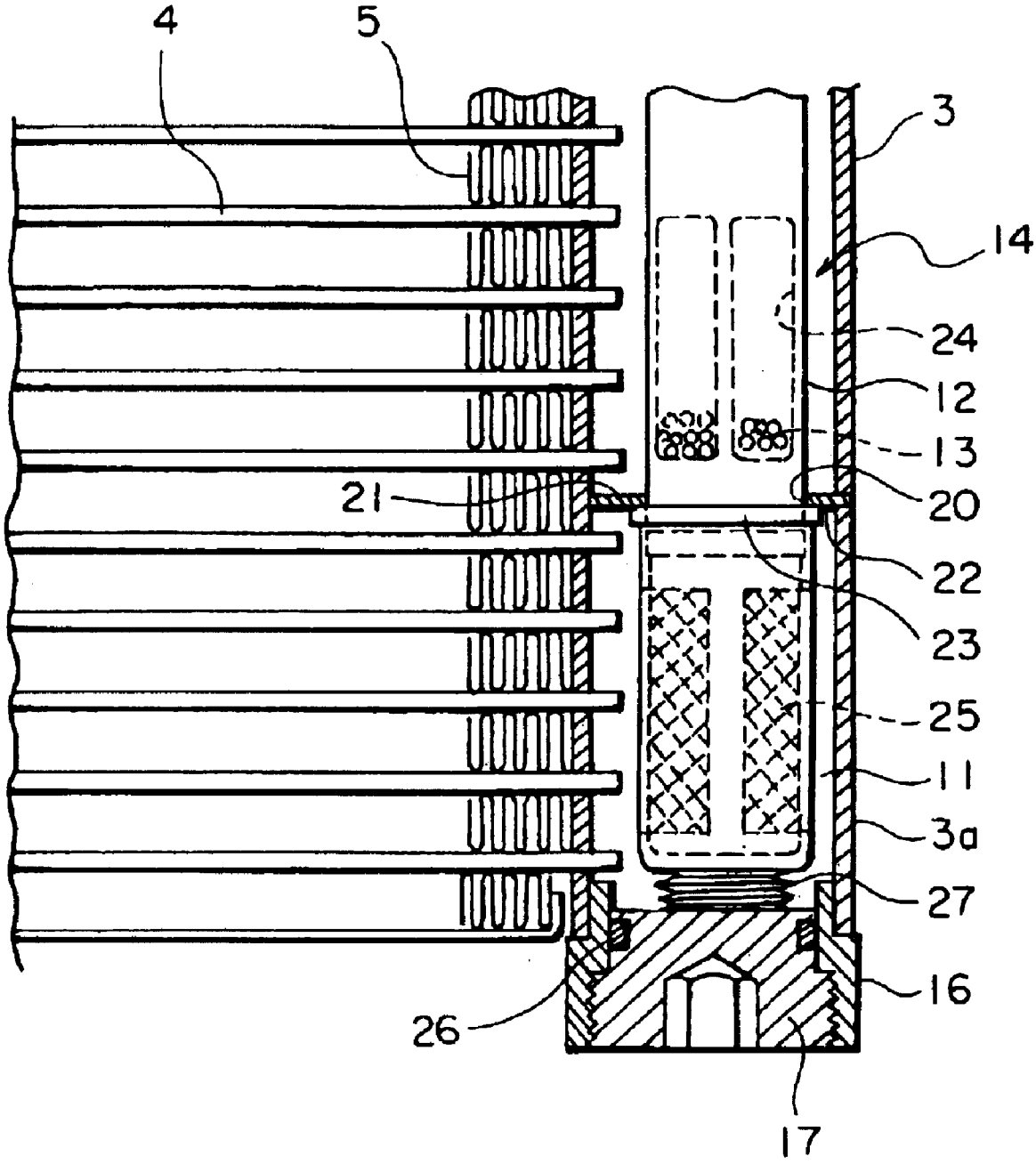
FIG. 3 is an enlarged, partial, cutaway view of a header pipe of a heat exchanger according to another embodiment of the present invention.

Referring to FIG. 3, heat exchanger 1 according to another embodiment of the present invention is depicted. The features and advantages of this embodiment of the present invention are substantially similar to the features and advantages of the above-described embodiments of the present invention. Therefore, the features and advantages of this embodiment of the present invention which are substantially similar to the above-described embodiments of the present invention, are not discussed further with respect to this embodiment of the present invention. In this embodiment, an elastic bellow 27, e.g., a bellow manufactured from rubber, resin, or the like, may be fixed to the first cap 17 or to insert 14, such that insert 14 may be resiliently supported between supporting plate 21 and elastic bellow 27.

Figure 4:
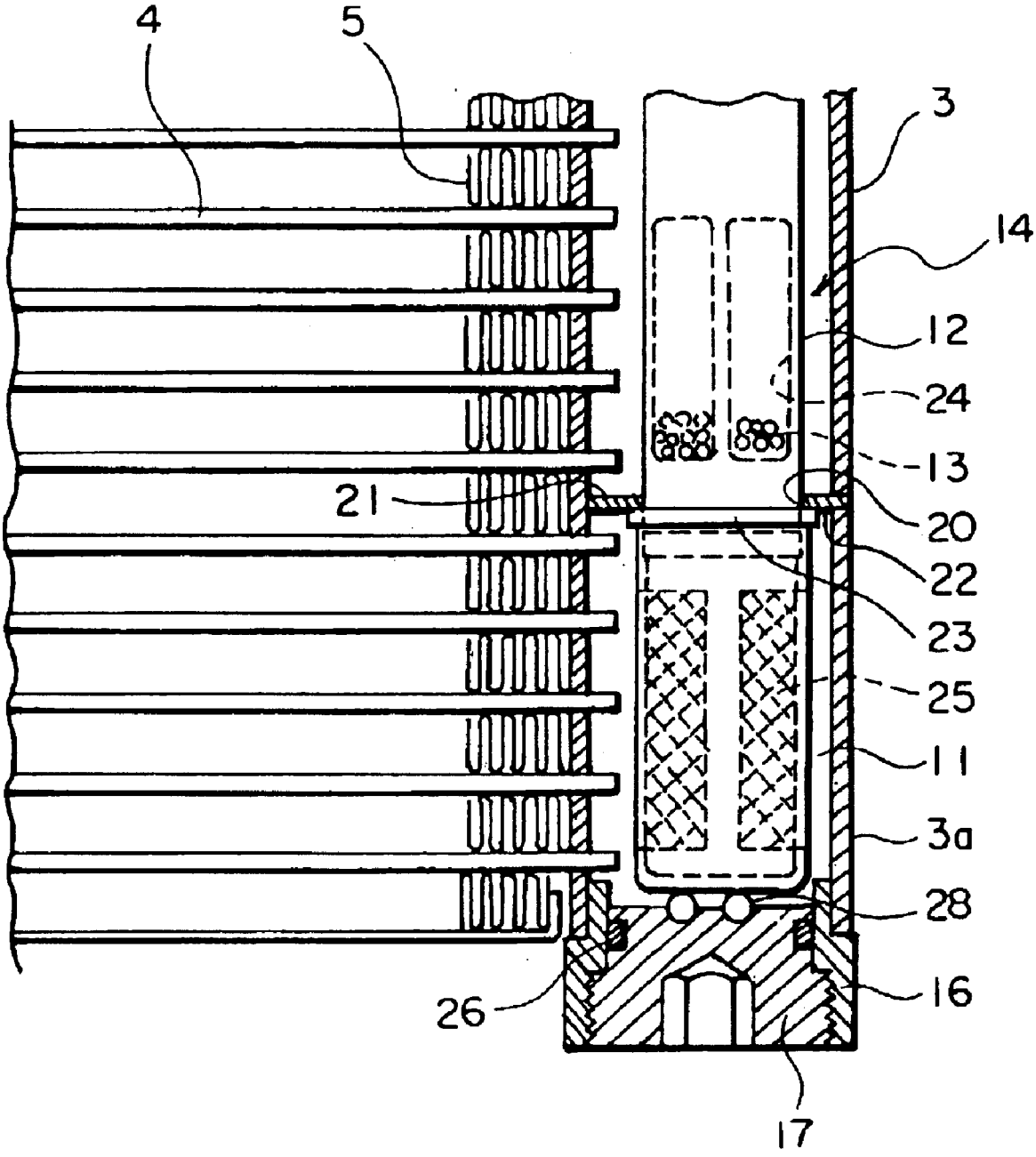
FIG. 4 is an enlarged, partial, cutaway view of a header pipe of a heat exchanger according to still another embodiment of the present invention.

Referring to FIG. 4, heat exchanger 1 according to yet another embodiment of the present invention is depicted. The features and advantages of this embodiment of the present invention are substantially similar to the features and advantages of the above-described embodiments of the present invention. Therefore, the features and advantages of this embodiment of the present invention which are substantially similar to the above-described embodiments of the present invention, are not discussed further with respect to this embodiment of the present invention. In this embodiment, an elastic O-ring 28, e.g., an O-ring manufactured from rubber, resin, or the like, may be fixed to the first cap 17 or to insert 14, such that insert 14 may be resiliently supported between supporting plate 21 and elastic O-ring 28.

Figure 5:
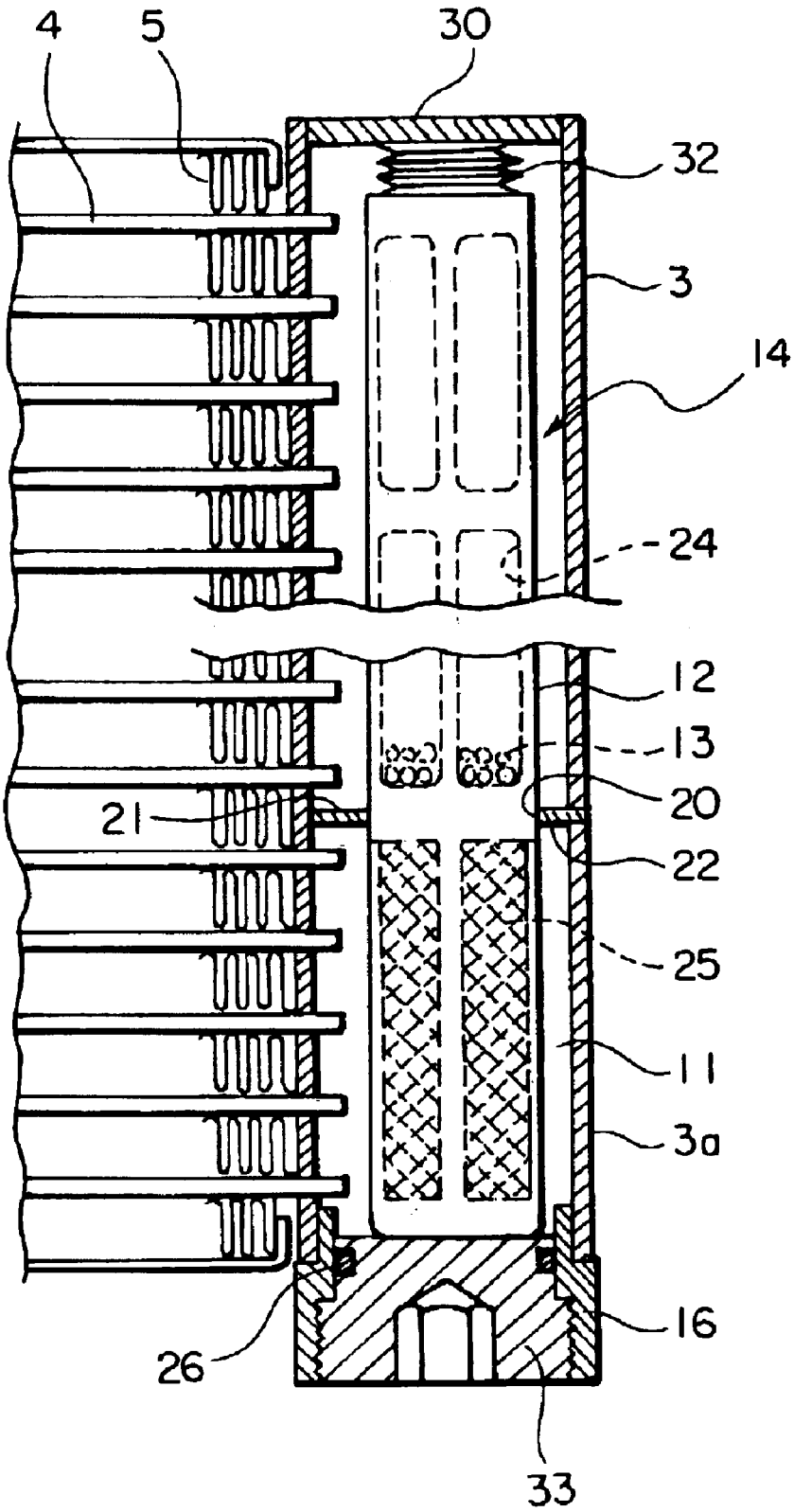
FIG. 5 is an enlarged, partial, cutaway view of a header pipe of a heat exchanger according to yet another embodiment of the present invention.

Referring to FIG. 5, heat exchanger 1 according to still another embodiment of the present invention is depicted. The features and advantages of this embodiment of the present invention are substantially similar to the features and advantages of the above-described embodiments of the present invention. Therefore, the features and advantages of this embodiment of the present invention which are substantially similar to the above-described embodiments of the present invention, are not discussed further with respect to this embodiment of the present invention. In this embodiment, first cap 17 and second cap 18 may be replaced by a third cap 33 and a fourth cap 30, respectively. Specifically, fourth cap 30 may seal the second opening of second header pipe 3, and third cap 33 may be screwed into the opening of cylindrical member 16, such that cylindrical member 16 and third cap 33 seal the first opening of second header pipe 3. Moreover, seal member 26 may be positioned between first cap 17 and the inner surface of cylindrical member 16. In this embodiment, an elastic bellow 32, e.g., a rubber bellow or a resin bellow, may be fixed to fourth cap 33 or to insert 14. When insert 14 vibrates, e.g., when heat exchanger 1 vibrates, elastic bellow 32 may compress and deform to absorb the vibrational motion of insert 14. Consequently, noise generated by the vibration of insert 14 may be reduced relative to the noise generated by the vibration of inserts in known heat exchangers, and insert 14 is less likely to be damaged by such vibration.

Figure 6:
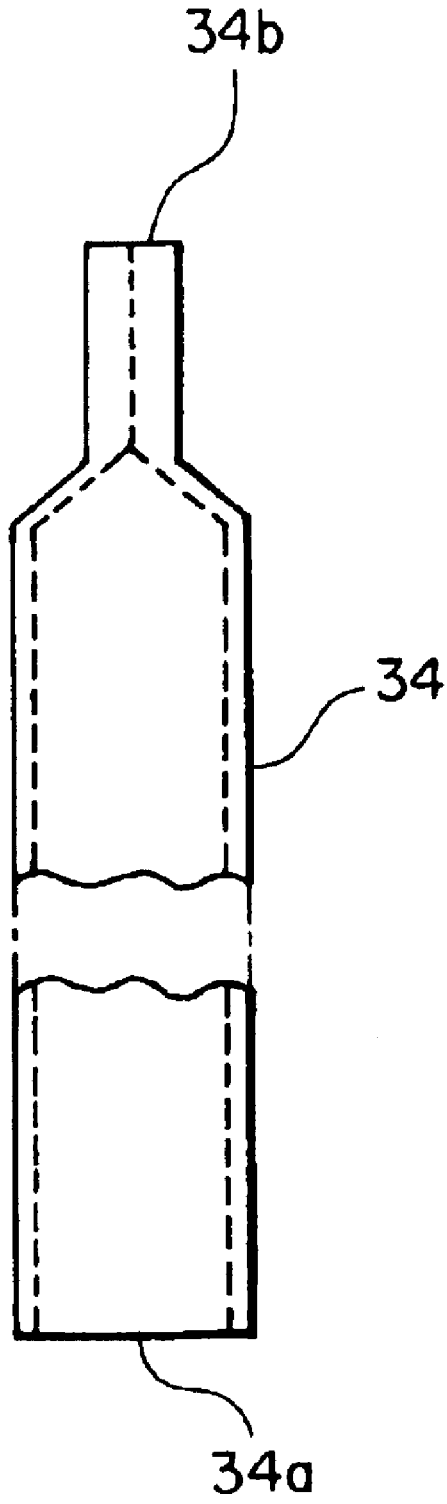
FIG. 6 depicts a header pipe of a heat exchanger according to still yet another embodiment of the present invention.

Referring to FIG. 6, a header pipe 34 according to still yet another embodiment of the present invention is depicted. The features and advantages of header pipe 34 are substantially similar to the features and advantages of second header pipe 3. Therefore, the features and advantages of header pipe 34 and second header pipe 3, which are substantially similar, are not discussed farther with respect to header pipe 34. In this embodiment, second header pipe 3 may be replaced by header pipe 34. Header pipe 34 may comprise a first opening formed through a first end 34*a* of header pipe 34, and a cap (not shown) may seal the first opening of header pipe 34. Moreover, a second end of header pipe 34 may be tapered, such that an internal diameter of the second end of header pipe 34 is zero or approaches zero.

While the invention has been described in connection with preferred embodiments, it will be understood by those skilled in the art that variations and modifications of the preferred embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. A heat exchanger comprising:

a pipe having at least one opening formed therein;

an insert comprising a case and a strainer portion positioned within the pipe;

at least one cap member for sealing the at least one opening;

a support member for resiliently supporting and positioned adjacent to the strainer portion of the insert, which is positioned between the strainer portion of the insert and the at least one cap member; and a plate positioned within the pipe, wherein the plate comprises an insert hole formed therethrough;

wherein the insert comprises a flange having an outer diameter which is greater than a diameter of the insert hole.

2. The heat exchanger of claim 1, wherein the pipe comprises a header pipe, and the at least one opening is formed through at least one end of the header pipe.

3. The heat exchanger of claim 2, wherein the at least one opening comprises:

a first opening formed through a first end of the header pipe; and a second opening formed through a second end of the header pipe, wherein the at least one cap member comprises:

a first cap member for sealing the first opening; and a second cap member for sealing the second opening.

4. The heat exchanger of claim 2, wherein the at least one opening is formed through a first end of the header pipe, and a second end of the header pipe is tapered, such that an internal diameter of the second end of the header pipe is zero or approaches zero.

5. The heat exchanger of claim 1, wherein the support member urges the insert to move in a predetermined direction, such that the flange engages the plate.

6. The heat exchanger of claim 1, wherein the support member is fixed to the at least one cap member.

7. The heat exchanger of claim 1, wherein the support member comprises an elastic protrusion.

8. The heat exchanger of claim 1, wherein the support member comprises a bellow.

9. The heat exchanger of claim 1, wherein the support member comprises an O-ring.

10. The heat exchanger of claim 1, wherein the insert comprises a desiccant unit.

11. The heat exchanger of claim 10, wherein the desiccant unit comprises a desiccant.

12. The heat exchanger of claim 1, wherein the at least one cap member comprises:

a cylindrical member fixed to the pipe, wherein the cylindrical member comprises an opening formed therein; and a cap positioned within the opening of the cylindrical member.

13. The heat exchanger of claim 1, wherein the pipe comprises storage tank containing the strainer portion of the insert.

14. A heat exchanger comprising:

a pipe having at least one opening formed therein;

an insert comprising a case and a strainer portion positioned within the pipe;

at least one cap member for sealing the at least one opening;

a support member for resiliently supporting the insert, wherein the strainer portion is positioned adjacent to the at least one cap member; and a plate positioned within the pipe, wherein the plate comprises an insert hole formed therethrough;

wherein the insert comprises a flange having an outer diameter which is greater than a diameter of the insert hole.

15. The heat exchanger of claim 14, wherein the support member is fixed to the insert.

* * * * *